US009784470B2

(12) United States Patent
Sedlacek et al.

(10) Patent No.: US 9,784,470 B2
(45) Date of Patent: Oct. 10, 2017

(54) FLUID HEATER

(71) Applicant: HOTSTART, INC., Spokane, WA (US)

(72) Inventors: David R Sedlacek, Athol, ID (US); Michael T Abbott, Spokane Valley, WA (US); Christopher Michael McFarland, Spokane, WA (US)

(73) Assignee: HOTSTART, Inc., Spokane, WA (US)

( * ) Notice: Subject to any disclaimer, the term of this patent is extended or adjusted under 35 U.S.C. 154(b) by 367 days.

(21) Appl. No.: 14/265,052

(22) Filed: Apr. 29, 2014

(65) Prior Publication Data

US 2014/0233930 A1 Aug. 21, 2014

Related U.S. Application Data

(63) Continuation of application No. 12/930,024, filed on Dec. 22, 2010, now abandoned.

(51) Int. Cl.

| | |
|---|---|
| ***F24H 1/08*** | (2006.01) |
| ***B05B 1/24*** | (2006.01) |
| ***F24H 1/10*** | (2006.01) |
| ***F24H 9/20*** | (2006.01) |

(52) U.S. Cl.

CPC ..... *F24H 1/101* (2013.01); *F24H 1/102* (2013.01); *F24H 9/2028* (2013.01); *F24H 2240/06* (2013.01); *F24H 2250/02* (2013.01)

(58) Field of Classification Search

None

See application file for complete search history.

(56) References Cited

U.S. PATENT DOCUMENTS

| | | | | |
|---|---|---|---|---|
| 1,267,416 | A * | 5/1918 | Jacob | F02N 19/10 123/142.5 E |
| 1,683,920 | A * | 9/1928 | Rohne | F02N 19/10 219/208 |
| 2,749,049 | A * | 6/1956 | Smith | B60H 1/03 237/12.3 B |
| 2,819,373 | A * | 1/1958 | Allman | B60H 1/00257 219/202 |
| 2,895,678 | A * | 7/1959 | Fairbanks | B60H 1/00007 237/12.3 B |
| 3,131,864 | A * | 5/1964 | Young | B60H 1/032 123/142.5 R |
| 3,236,220 | A * | 2/1966 | Holmes | F01P 7/16 123/142.5 R |
| 3,673,379 | A * | 6/1972 | Eversull | B60H 1/034 219/202 |

(Continued)

OTHER PUBLICATIONS

PCT Search Report for PCT/US2011/01965, International Filing Date Jul. 12, 2011.

*Primary Examiner* — Thor Campbell

(74) *Attorney, Agent, or Firm* — Lee & Hayes, PLLC

(57) ABSTRACT

A fluid heater is disclosed and which has a heater, pump, and a plurality of temperature sensors which are electrically coupled with first and second temperature controlled relays, and wherein the fluid heater is operable to maintain a source of fluid used by an object of interest within a predetermined temperature range and further, is operable under given temperature conditions to discontinue operation so as to protect the object of interest and the heater from becoming damaged through overheating of the fluid which is utilized by same.

10 Claims, 6 Drawing Sheets

(56) References Cited

U.S. PATENT DOCUMENTS 3,758,031 A * 9/1973 Moran ..... B60H 1/2209 123/142.5 R
3,795,234 A * 3/1974 Stolz ..... B60H 1/032 123/142.5 R
4,010,895 A * 3/1977 Kofink ..... B60H 1/032 237/12.3 C
4,018,380 A * 4/1977 Baier ..... B60H 1/00 237/12.3 C
4,398,081 A * 8/1983 Moad ..... B60H 1/034 123/142.5 E
4,458,642 A 7/1984 Okubo et al.
4,770,134 A * 9/1988 Foreman ..... F02N 19/10 123/142.5 R
4,815,431 A 3/1989 Yorita et al.
4,968,869 A * 11/1990 Copeland ..... B60S 1/54 219/202
5,012,070 A * 4/1991 Reed ..... B60R 16/04 219/202
5,036,803 A * 8/1991 Nolting ..... F01P 5/10 123/41.05
5,172,656 A * 12/1992 Wright ..... F01P 3/18 123/41.01
5,211,333 A * 5/1993 Schmalenbach ..... B60H 1/032 237/12.3 C
5,275,538 A * 1/1994 Paliwoda ..... F04D 13/021 123/41.46
5,279,503 A * 1/1994 Propst ..... F04D 13/021 123/41.46
5,435,277 A * 7/1995 Takahashi ..... F01P 11/20 123/142.5 E
5,443,053 A * 8/1995 Johnson ..... F02M 31/16 123/557
5,482,432 A * 1/1996 Paliwoda ..... F04D 13/021 123/41.46
5,558,055 A * 9/1996 Schatz ..... B60H 1/00492 123/142.5 R
5,632,917 A * 5/1997 Cummins ..... H05B 3/84 219/202
5,895,590 A * 4/1999 Suzuki ..... F16H 57/0412 219/202
5,991,509 A * 11/1999 Goto ..... B60H 1/2221 392/441
6,332,580 B1 12/2001 Enander et al.
6,612,504 B2 * 9/2003 Sendzik ..... B63J 2/14 165/41
6,745,829 B2 * 6/2004 Mehraban ..... B60H 1/00885 165/203
6,928,237 B2 8/2005 Matsunaga et al.
6,981,480 B2 * 1/2006 Oleksiewicz ..... F02D 41/064 123/142.5 E
7,036,746 B2 * 5/2006 Murgu ..... B60H 1/2209 165/41
7,258,092 B2 * 8/2007 Beaucaire ..... F02D 41/20 123/142.5 E
7,793,856 B2 * 9/2010 Hernandez ..... B60H 1/00314 237/12.3 B
8,807,445 B2 * 8/2014 Ribadeneira ..... B60H 1/004 237/2 B
8,997,847 B2 * 4/2015 Schwartz ..... F01P 7/042 165/244
9,260,103 B2 * 2/2016 Porras ..... B60H 1/00385
9,375,994 B2 * 6/2016 Eisenhour ..... B60H 1/2218
2009/0107974 A1 4/2009 Testa

* cited by examiner

FLUID HEATER

RELATED APPLICATIONS

The present application claims priority to U.S. patent application Ser. No. 12/930,024 filed on Dec. 22, 2010, entitled "Fluid Heater," which is incorporated by reference herein in its entirety.

TECHNICAL FIELD

This invention relates to a fluid heater having particular utility when used with an internal combustion engine or motor, and more specifically to a fluid heater which maintains the temperature of a source of fluid utilized by an internal combustion engine or motor at an appropriate temperature so as to facilitate the operation of same.

BACKGROUND OF THE INVENTION

The beneficial effects of employing various types of heater assemblies for maintaining the temperature of a source of fluid such as a lubricant or coolant and which is supplied to an internal combustion engine is well. known. Various block heaters, of assorted designs, have been utilized with internal combustion motors which are used on assorted overland vehicles, such as locomotives, diesel operated trucks and automobiles in order to allow such vehicles to effectively operate during extremely cold temperatures. In some non-mobile applications, diesel motors are employed to drive sub-assemblies such as electrical generators which may be utilized as back-up power to support the operations of buildings such as hospitals, and the like, in the event that electricity is interrupted to the building as might occur during natural emergencies, such as winter storms, and similar events. In order to ensure that these internal combustion motors operate effectively, heaters have been utilized to maintain the temperature of the fluids used with these internal combustion motors at an elevated temperature such that the internal combustion motor or engine can be easily started and then operated notwithstanding what the outside ambient temperature or conditions might be.

While earlier heater designs employed for the purposes, noted above, have worked with varying degrees of success, there have been shortcomings which have detracted from their usefulness. Chief among the shortcomings associated with these heater assemblies has been the propensity for such heaters to remain operational (energized) long after their need is no longer required. Further, and under some circumstances, this same characteristic for continued operation has contributed to the overheating of the internal combustion engine and damage to the heating assembly itself or other subassemblies.

Therefore, a fluid heating assembly which avoids the detriments associated with the individual prior art practices and designs utilized heretofore is the subject matter of the present application.

SUMMARY OF THE INVENTION

A first aspect of the present invention relates to a fluid heater which includes an object of interest which has a predetermined operational temperature range, and a maximum operational temperature; a source of fluid utilized by the object of interest; a pump having an electric motor, and which when energized removes and returns the source of fluid from the object of interest; a heater coupled to the pump and which when energized heats the source of fluid delivered to the heater by the pump; a first temperature sensor for detecting the temperature of the source of fluid which is received from the object of interest; a second temperature sensor for detecting the temperature of the source of fluid which is leaving the heater; a first temperature controlled relay electrically coupled with the first temperature sensor, and with the heater, and wherein the first temperature controlled relay is configured to periodically electrically open and close so as to de-energize and then energize the heater so as to maintain the source of fluid utilized by the object of interest in the predetermined operational temperature range while the pump remains operational; and a second temperature controlled relay electrically coupled with the second temperature sensor, the heater, and the pump, and wherein the second temperature controlled relay assumes an electrically opened position when the temperature of the source fluid as sensed by the second temperature sensor is within the predetermined operational temperature range of the object of interest, and further assumes an electrically closed position, which de-energizes the heater, and the electric pump, when the second temperature sensor detects a fluid temperature which is greater than the predetermined operational temperature range of the object of interest, but less than the maximum operational temperature thereof.

Another aspect of the present invention relates to a fluid heater which includes an object of interest which, in operation, has a predetermined operational temperature range, and a maximum operational temperature; a source of fluid which is utilized within the object of interest, and which facilitates, at least in part, the maintenance of the operational temperature of the object of interest; a pump, having a pump motor, and which is coupled in fluid flowing relation relative to the object of interest, and which, when energized, removes and then returns the source of fluid to the object of interest; a heater which is positioned in downstream fluid receiving relation relative to the pump, and pump motor, and which is further located in upstream fluid delivering relation relative to the object of interest, and wherein the heater, when energized, imparts heat energy to the fluid which is supplied to the heater by the pump; a first temperature sensor positioned in upstream, fluid flowing relation relative to the heater, and wherein the first temperature sensor detects the temperature of the fluid which is received from the object of interest; a second temperature sensor positioned in downstream, fluid flowing relation relative to the heater, and which is further positioned upstream relative to the object of interest, and wherein the second temperature sensor detects the temperature of the source of fluid as the source of fluid leaves the heater, and travels back to the object of interest; a first temperature controlled relay which is electrically coupled to the first temperature sensor and which, when electrically closed, is effective in energizing the heater, and when electrically opened is effective in de-energizing the heater; and a second temperature controlled relay, which is electrically coupled with the second temperature sensor, and which further assumes an electrically opened position when the temperature of the fluid, as sensed by the second temperature sensor, is below or within the predetermined operational range of the object of interest, and wherein the first temperature controlled relay further periodically assumes electrically open and closed positions so as to facilitate the heating and maintenance of the source of fluid at a temperature which is within the predetermined operational range of the object of interest, and wherein the first temperature controlled relay further assumes an open electrical position when the temperature of the fluid, as sensed by the first temperature sensor, exceeds the predetermined operational temperature range, but is below the maximum operational temperature of the object of interest, and wherein the pump, and pump motor continue to operate so as to remove, and then return the source of fluid to the object of interest, while the heater is periodically energized and de-energized, and wherein, when the second temperature sensor detects a given fluid temperature which is greater than the predetermined operational temperature range of the object of interest, and less than the maximum operational temperature thereof, the second temperature controlled relay electrically closes, and is effective in de-energizing both the heater and the pump motor of the pump so as to substantially prohibit damage to the fluid heater and the object of interest.

Still another aspect of the present invention relates to a fluid heater which includes an object of interest which has a predetermined operational temperature range, and a maximum operational temperature, and wherein a signal for activating and deactivating the fluid heater is provided to the fluid heater, and a source of electricity is supplied to energize the fluid heater, and wherein a source of fluid is utilized by the object of interest; a transformer electrically coupled with the source of electricity, and which produces a given voltage output which energizes the fluid heater; a motor protective switch electrically coupled with the source of electricity; an electric motor made integral with a fluid pump, and which is electrically coupled with the motor protective switch, and wherein the pump is coupled in fluid withdrawing relation relative to the object of interest, and wherein the electric motor, when energized by the source of electricity causes the pump to withdraw the source of fluid from the object of interest; a first plurality of electrical contactors electrically coupled to the source of electricity and positioned therebetween the motor protective switch and the source of electricity, and which, when placed in an electrically closed position electrically couples the electric motor to the source of electricity, and when placed in an electrically opened position decouples the electric motor from the source of electricity; a heater electrically coupled to the source of electricity, and which further, is coupled in fluid receiving relation relative to the pump, and is disposed in fluid delivering relation relative to the object of interest, and wherein the heater is effective, when energized, to heat the source of fluid, which is then returned to the object of interest; a second plurality of electrical contactors electrically coupled to the source of electricity and positioned therebetween the heater, and the source of electricity, and which, when placed in an electrically closed position electrically couples the heater to the source of electricity, and when placed in an electrically open position, electrically decouples the heater from the source of electricity; an operator switch which is operably coupled to the fluid heater, and the transformer, and further is disposed in signal receiving relation relative to the signal, and which activates and deactivates the fluid heater; a first temperature sensor positioned in upstream, fluid flowing relation relative to, and operably coupled with, the heater, and wherein the first temperature sensor detects the temperature of the fluid which is received from the object of interest; a second temperature sensor positioned in downstream, fluid flowing relation relative to the heater, and which is further positioned upstream relative to the object of interest, and wherein the second temperature sensor detects the temperature of the fluid as the source of fluid leaves the heater, and is supplied back to the object of interest; a first temperature controlled relay which is electrically coupled to the first temperature sensor, heater, and the second plurality of electrical contactors, and which, when electrically closed, is effective in energizing the heater, and when electrically opened, is effective in de-energizing the heater, and wherein the first temperature controlled relay is configured to periodically electrically open and close so as to de-energize and energize the heater so as to maintain the source of the fluid utilized by the object of interest in the predetermined operational temperature range while the pump remains operational to withdraw fluid from the object of interest, and deliver the fluid to the heater, and return the source of fluid to the object of interest; and a second temperature controlled relay electrically coupled with the second temperature sensor, the heater, the pump, and the first and second plurality of electrical contactors, and wherein the second temperature controlled relay assumes an electrically opened position when the temperature of the source fluid, as sensed by the second temperature sensor, is within the predetermined operational temperature range of the object of interest, and further assumes an electrically closed position, which is effective in causing the first and second plurality of contactors to assume an open electrical position which de-energizes the heater, and electric motor which energizes the pump, when the second temperature sensor detects a fluid temperature which is greater than the predetermined operational temperature range of the object of interest, but less than the maximum operational temperature thereof.

These and other aspects of the present invention will be discussed in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
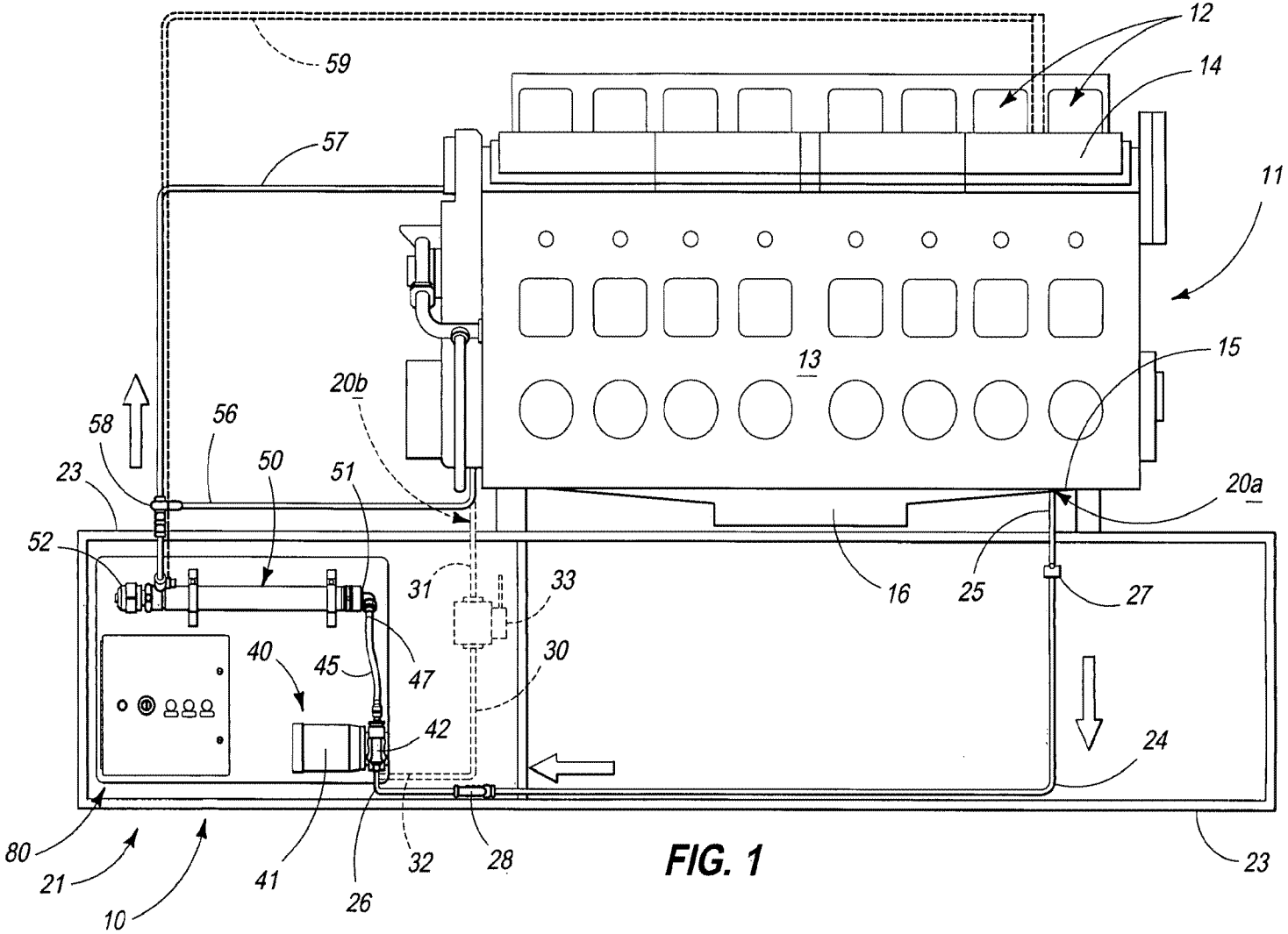
FIG. 1 is a simplified, fragmentary, schematic view of the fluid heater of the present invention, and which shows the broad features thereof.

Referring more particularly to the drawings, the fluid heater 10 of the present invention is best understood, in its broadest aspect, by a study of FIG. 1. As seen therein, the invention 10 relates to a fluid heater which is operably coupled in fluid flowing relation relative to an object of interest, here depicted as internal combustion motor or engine of conventional design and which is designated by the numeral 11. The internal combustion motor or engine 11, as illustrated, is a diesel-type motor or engine which has a multiplicity of cylinders 12 which are made integral with an engine block 13 of conventional design. The engine block has a top portion 14, and a bottom portion 15. An oil sump 16 is made integral with the bottom portion 15. As will be discussed hereinafter, the fluid heater 10 of the present invention has specific features which permit it to be operably coupled in fluid flowing relation with various objects of interest, such as the internal combustion motor 11, and wherein the object of interest such as the internal combustion motor 11 has a predetermined operational temperature range, and a maximum operational temperature range. The specific features of the fluid heater 10 will now be discussed in the paragraphs, below.

The fluid heater 10 of the present invention, and which is useful when coupled with an object of interest, here illustrated as an internal combustion motor 11, which has a predetermined operational temperature range, and a maximum operational temperature, utilizes a source of fluid, here indicated by the numerals 20A, or 20B, respectively. The source of fluid 20A which is utilized by the internal combustion motor 11 may be a lubricant, such as a source of oil, or the like, and which may be removed from the engine block 13 at a suitable location preferably near the oil sump 16 by the fluid heater 10. Further, a source of coolant 20B may be received from the engine block 13 and may be removed from a suitable location as indicated by the arrow labeled 20B in FIG. 1. As seen in the drawings, the invention 10 is enclosed within a housing which is generally indicated by the numeral 21. The housing 21 has a base portion 22 as best seen by reference to FIG. 2 and which supports various components of the fluid heater 10 as will be discussed, later in this specification. Further, a multiplicity of frame rails 23 enclose and are attached to the base portion. The component portions of the fluid heater 10 are typically located within the housing or enclosure 21. In the drawings, the source of fluid 20A (lubricant), is removed from the engine block 13 of the internal combustion motor 11 by means of a lubricant intake line which is indicated by the numeral 24. The lubricant intake line has a first end 25, which is coupled in fluid receiving relation relative to the engine block 13, and further has an opposite, discharge end 26 which is coupled in fluid delivering relation relative to a pump which will be discussed in greater detail below. Further as seen in FIG. 1, a one-way check valve 27 is made integral with the lubricant intake line 24, and is positioned between the first and second ends 25 and 26. This one-way check valve 27 permits the source of fluid 20A to move in only one direction, that is, towards the heating assembly 10 as will be described in the paragraphs which follow. The lubricant intake line 24 further has adjacent to its second end 26, a hand operated ball valve 28 which allows an operator to selectively interrupt the flow of the source of fluid, here a lubricant 20A, so as to allow the heater assembly 10 to be disconnected for modification, maintenance, or the like.

The present invention, in the alternative, may be coupled to a source of coolant 20B which is utilized by the object of interest, here depicted as an internal combustion motor 11. The coolant 20B exits the engine block 13 near the bottom thereof 15, and is received within a coolant intake conduit or line 30. The coolant intake conduit or line 30 has a first end 31, which is coupled in fluid receiving relation relative to the engine block 13, and an opposite, second end 32, which is coupled in fluid delivering relation relative to a pump which will be discussed below. As illustrated, and in this alternative form of the environment, a full flow ball valve 33 which can be selectively hand-operated is coupled therebetween the first and second ends 31 and 32. The full flow ball valve allows an operator to interrupt the flow of coolant from the internal combustion motor 11 when the present invention 10 is being modified, maintained or the like. In yet another possible form of the invention, a heater assembly 10 may be fabricated which allows for the heating of both the lubricant 20A and the coolant 20B. In this arrangement, which is not shown, the fluid heater would include a second pump, and heater as will be discussed in greater detail in the paragraphs which follows.

Figure 2:
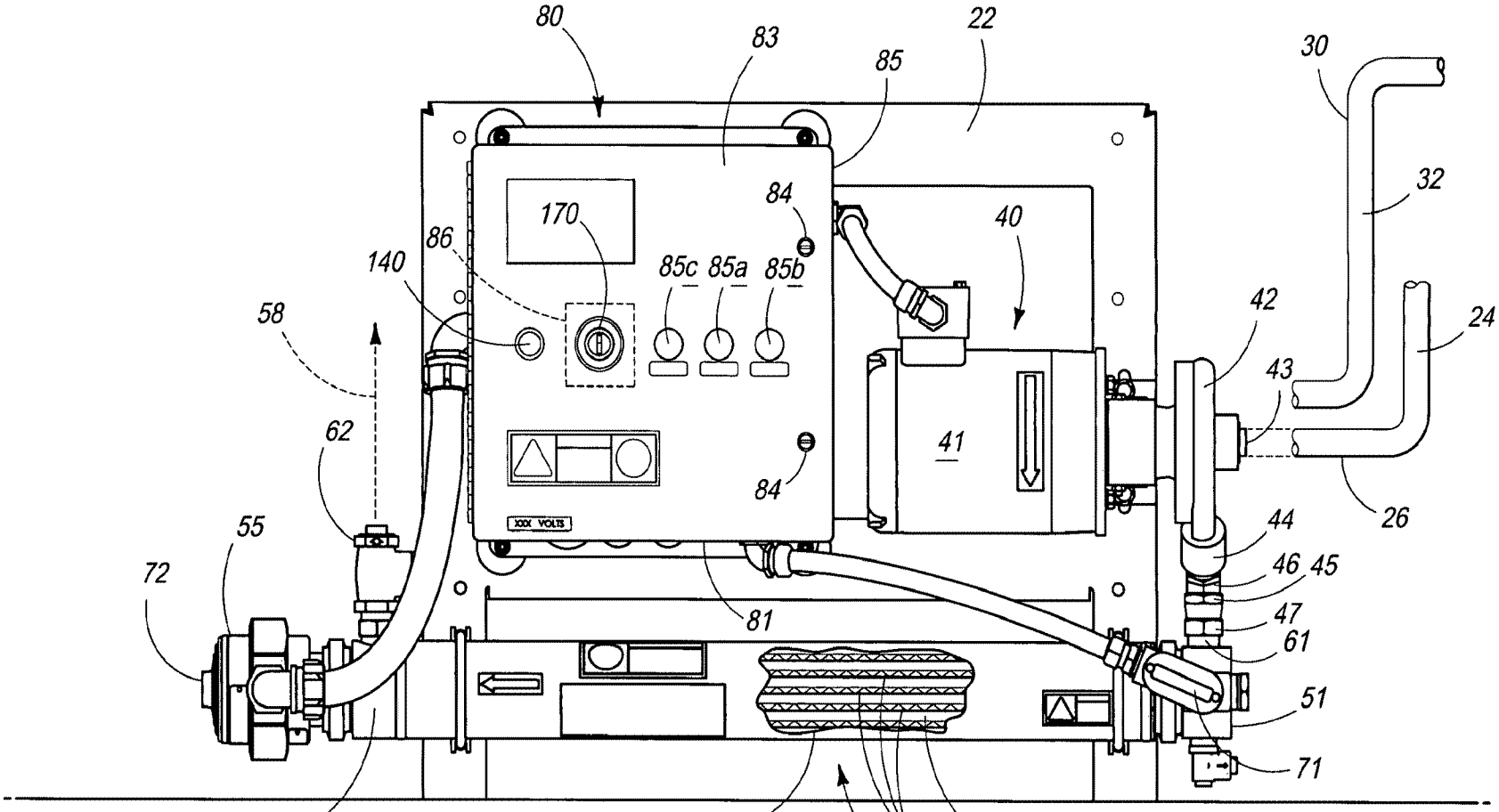
FIG. 2 is a perspective, top plan view of the fluid heater of the present invention.

Referring now to FIG. 2, the fluid heater 10 of the present invention includes a fluid pump which is generally indicated by the numeral 40. The fluid pump is of conventional design and is energized by an electric pump motor 41. The pump motor 41, when energized, is operable to mechanically cooperate with a fluid pumping unit or assembly 42 which is made integral, therewith. The pumping unit 42 has a pump intake 43, and a pump discharge or exhaust 44. The pump discharge or exhaust 44 is coupled in fluid flowing relation relative to a fluid supply conduit 45. The fluid supply conduit 45 has a first end 46, which is coupled to the exhaust outlet 44, and an opposite, second end 47, which is coupled in fluid delivering relation relative to a heater which will be described in the paragraphs which follow. It should be understood that the second end 26 of the lubricant intake line 24; or the second end 32 of the coolant intake conduit 30 (FIG. 1); is coupled to the pump intake 43 of the pumping unit 42. Likewise, in the alternate form of the invention, the coolant intake conduit 30 is coupled to the intake 43 of the pump 40.

You will note in FIG. 2 that the present invention 10 further includes a heater 50 of conventional design, and which has a first intake end 51, and a second exhaust end 52. The heater 50 has a main body 53 which defines an internal cavity 54 through which the source of fluid 20A or 20B travels while the heater 50 acts upon same to increase the temperature of the source of fluid 20A or B so it may then, subsequently, be delivered back to the object of interest, here illustrated as an internal combustion motor 11. As illustrated in FIG. 2, the heater 50 includes a plurality of heating elements 55 positioned within the internal cavity 54, and which, when selectively energized by a source of electricity, as will be discussed hereinafter, is operable to increase the temperature of the source of fluid 20A or B before the source of fluid 20A or B exits the heater 50 and is then delivered back to the object of interest, here illustrated as an internal combustion motor 11 by way of the fluid supply conduits 56 and 57. As seen in FIG. 1, conduit 56 extends to and is coupled in fluid flowing relation relative to the oil sump 26, and conduit 57 extends to and is coupled in fluid flowing relation relative to the top of the engine block 14. A hand operated valve 58 is located between these two previously mentioned conduits so as to direct the fluid 20A into either of these conduits. In place of this structure, a solenoid valve which is actuated by a timer, not shown, may be employed. When fluid is directed into conduit 57, this represents a pre-lube feature of the invention 10. This will be discussed in greater detail, below. Additionally, in the alternative form of the invention 10, a fluid supply conduit 59 is provided to deliver heated coolant 20B to the top 14 of the internal combustion motor 11.

As seen most clearly by reference to FIG. 2, the heater 50 has a first fluid intake end 61, which is coupled in fluid receiving relation relative to the second end 47, of the fluid supply conduit 45; and a second fluid exhaust end 62, which is coupled in fluid delivering relation relative to the fluid supply conduits 56/67. The heater 50 further includes a first temperature sensor 71, which is used for detecting the temperature of the source of fluid 20A or B which is received from the object of interest here indicated as an internal combustion motor 11. The first temperature sensor is located adjacent to the first fluid intake end 61. Further, the heater 50 has a second temperature sensor 72, which is positioned at the second end 62 of the heater 50, and which is useful for detecting the temperature of the source of fluid 20A or 20B which is leaving the heater 50 after it has been heated by the heating elements 55. The operation of the respective first and second temperature sensors 71, 72 in the present invention 10 will be discussed in greater detail in the paragraphs which follow.

Figure 3:
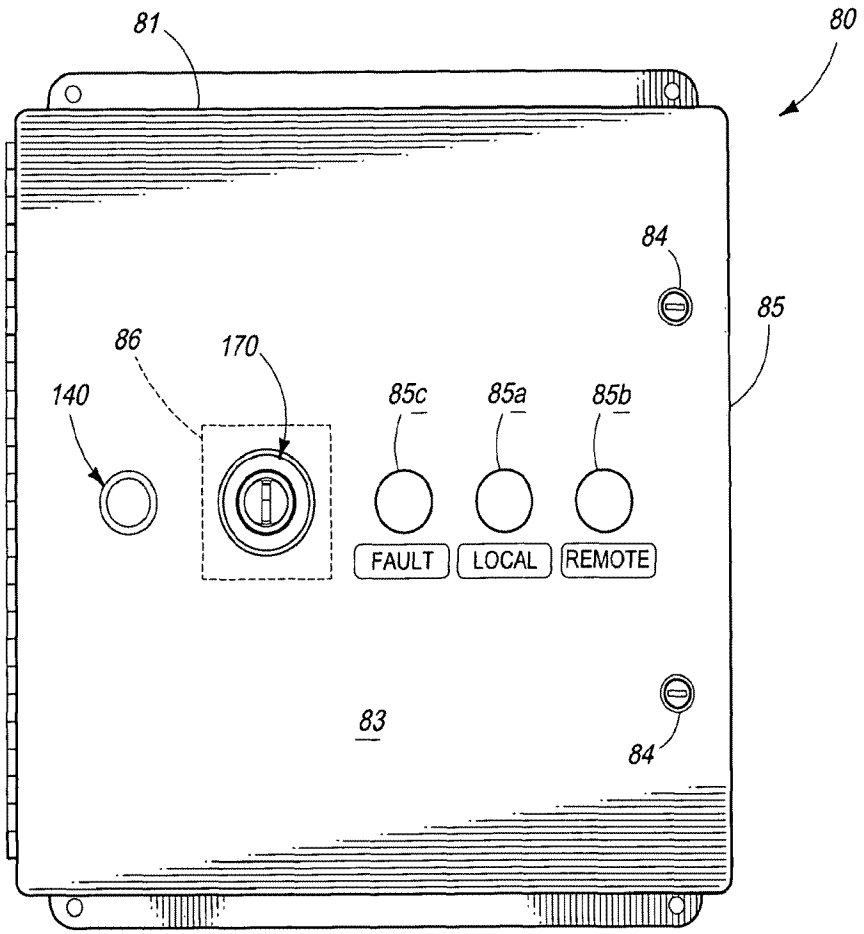
FIG. 3 is a top plan view of an electrical control box which forms a feature of the present invention.
Figure 4:
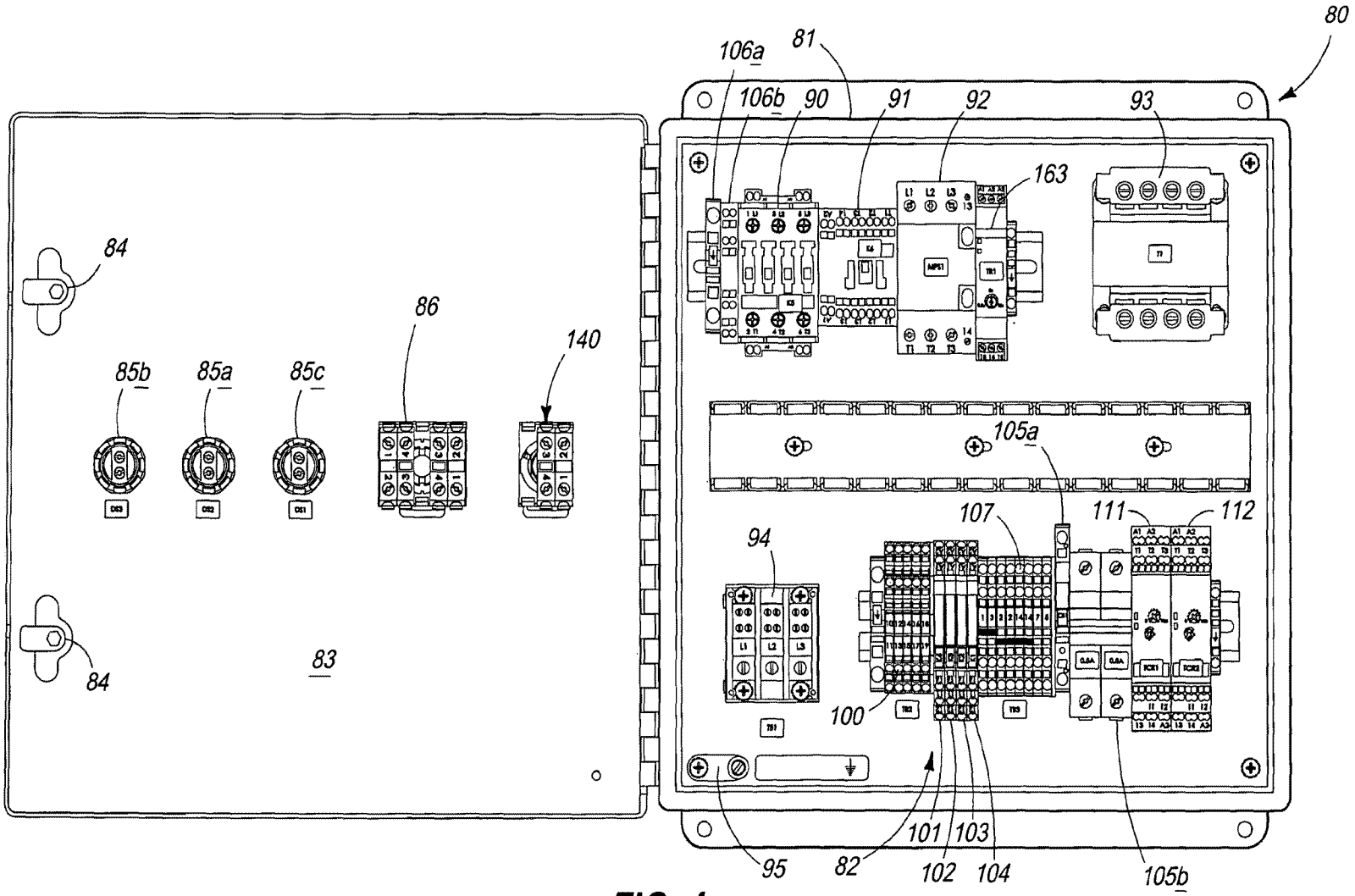
FIG. 4 is a top plan view of an opened, electrical control box which forms a feature of the present invention.

Referring now to FIG. 2-4, the fluid heater 10 of the present invention includes an electrical control housing which is generally indicated by the numeral 80. The electrical control housing 80 has a base, or first portion 81, which defines an internal cavity 82 (FIG. 4). The internal cavity 82 encloses and protects a number of electrical components which will be discussed in greater detail, below. Still further, the control housing 80 includes a hinged cover or door 83 which is moveably coupled with same, and which may be secured in a covering relationship over the base portion 81 by a multiplicity of conventional latches which are here indicated by the numeral 84. Still further, as seen in the drawings (FIGS. 3 and 4), a multiplicity of electrically energized indicator lights 85A, B, C are mounted on the hinged cover or door 83 and provide a convenient visual means by which an operator can quickly ascertain the current operational state of the fluid heater 10. A contact block 86 is further mounted on the inside surface of the cover or door 83. The operation of the respective indicator lights 85A, B, C and other features of the components enclosed within same will be discussed in greater detail, hereinafter. An operator actuated selection switch 170 is also mounted on the cover 83, and mechanically coupled with the contact block 86. The operation of this feature will be discussed later in this application.

Figure 6:
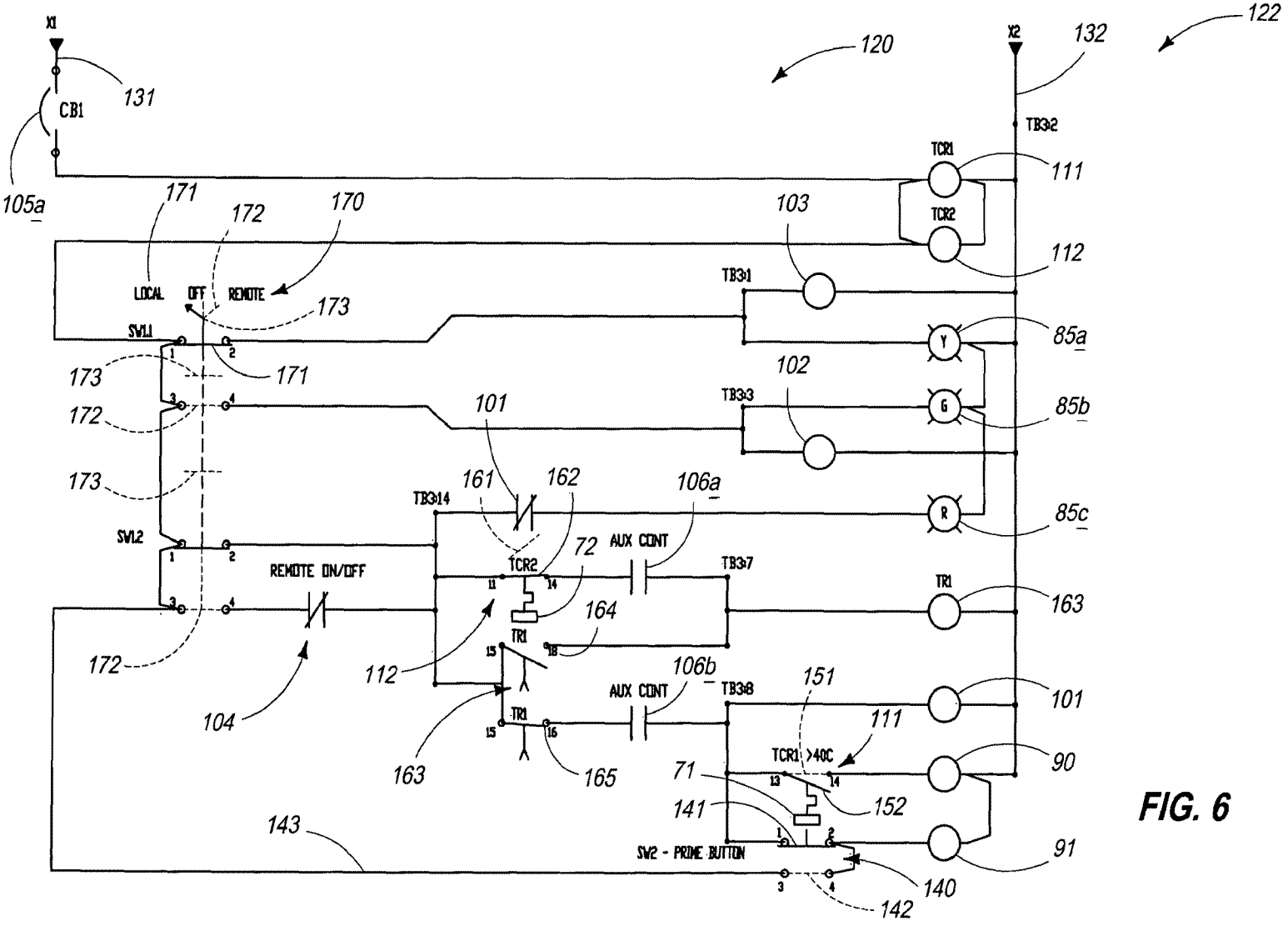
FIG. 6 is a second, schematic view of a second portion of a control circuit which finds usefulness in the present invention.

Referring now to FIG. 4, it should be understood that the electrical control housing 80 and more specifically the internal cavity 82 thereof encloses and protects a number of electrical sub-components which form features of the present invention 10. More specifically, and as one studies FIG. 4, it should be understood that many electrical conduits or wires have been removed from that view so as to enable a clear understanding of the present invention 10. Those skilled in the art will also readily recognize that these missing electrical conduits, of various sizes, would couple the various electrical components as will be discussed below, together, in order to provide the operational features of the present invention 10. Referring still to FIG. 4, the electrical control housing 80 encloses heating element contactors which are generally indicated by the numeral 90. These heating element electrical contactors are of conventional design, and may be purchased from various electrical wholesalers. The control housing 80 further encloses a pump motor contactor which is generally indicated by the numeral 91. This also includes an auxiliary contact for receiving a motor-run signal. Still further, the electrical control housing 80 encloses a motor protective switch 92 which is electrically coupled to the electric pump motor 41 as earlier described. Additionally, the control housing 80 encloses an electrical transformer 93. The transformer's 93 function will also be discussed, below. Additionally enclosed within the electrical control housing 80 is a main power connection point or block 94. An outside source of electricity 123 which will be described, below, is also coupled to the invention 10 at 94. Still further, enclosed within the electrical control housing 80 is a ground labeled 95. Moreover, enclosed within the electrical control housing 80 is a customer connection block 100; an alarm heater failure relay 101; a remote signal relay 102; a local signal relay 103; and a remote on/off relay 104. First and second circuit breakers 105A and B of conventional design are also enclosed, and are useful for electrically decoupling the transformer 93 in the electrical control box 80. Finally, first and second temperature controlled relays 111 and 112, respectively, are mounted within the electrical control housing 80 to perform the assorted novel features which will discussed in the paragraphs which follow. Additionally, and enclosed within the housing 80, is a ground 106A for the heating element 50 and an auxiliary electrical contactor 106B (FIG. 6). Additionally, a terminal block 107 receives, and electrically couples to assorted electrical conduits, not shown.

Figure 5:
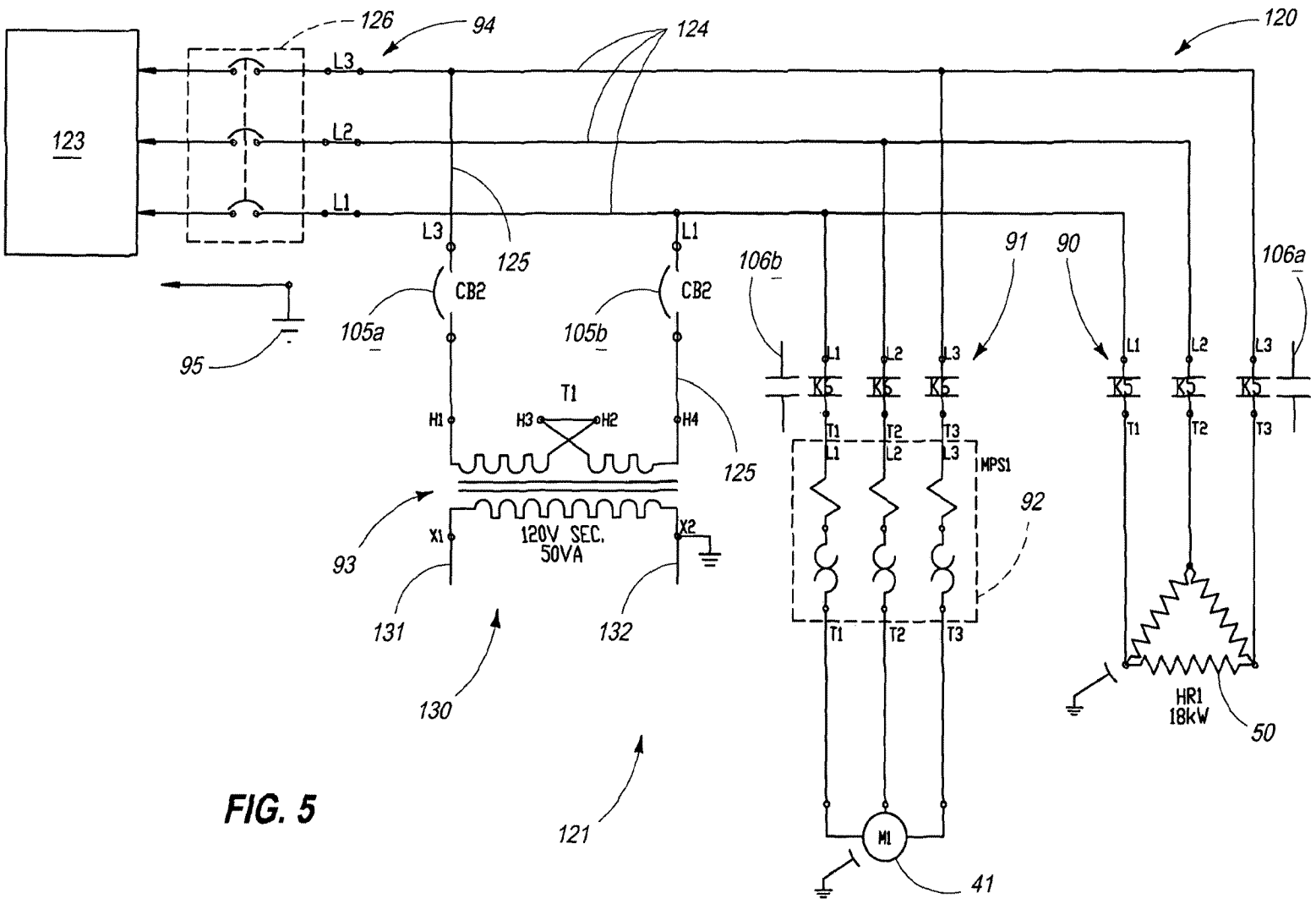
FIG. 5 is a schematic diagram of a first portion of a control circuit which finds usefulness in the present invention.

Referring now to FIGS. 5 and 6, it will be seen that the fluid heater 10 has, as one of its features, a control circuit which is generally indicated by the numeral 120. The control circuit 120 has a first portion 121, which is shown in FIG. 5; and a second portion 122 which is shown in FIG. 6. The control circuit 120 is coupled to a source of outside electrical power which is generally indicated by the numeral 123. Typically, this is power taken from the grid and delivered as 3 phase 480 volts. In other instances, it might be possible to provide this source power from the object of interest 11. Moreover, this could also be supplied from both sources. This source of outside power 123 is electrically coupled to the circuit 120 by means of a circuit breaker 126. The source of electrical power 123 is also provided to a plurality of electrical supply conduits which are generally indicated by the numeral 124 as seen in FIG. 5. A pair of electrical supply conduits 125 are electrically coupled to the individual electrical supply conduits 124, so as to supply electrical power to the transformer 93. This pair of electrical conduits 125 are respectfully electrically coupled to the individual first and second circuit breakers 105A and B, respectively. The transformer 93 has an electrical output, when energized, which is generally indicated by the numeral 130, and which is supplied to first and second electrical conduits 131 and 132, respectively. The transformer 93, in the arrangement as shown in FIG. 5, typically has a voltage output of about 120 volts AC.

Referring now to FIGS. 3 and 6, it will be understood by reviewing those drawings that the second portion 122, of the control circuit 120 includes a priming button, or switch 140 which has a first position 141; and a second position 142. In the first position 141, the priming button allows the electrical pump motor 40 to be energized during the operation of the control circuit 120. In the second position 142, the priming button allows the electric motor to be independently and selectively energized apart from the overall operation of the control circuit 120, so as to supply the source of fluid 20A to the engine block 13 of the internal combustion motor 11. More specifically, the priming button is typically employed so as to allow the pump motor 41 to withdraw the source of fluid 20A (lubricant) from the bottom of the engine block 15, and then supply fluid to the pump for priming to allow the pump to operate properly prior to starting the heater. This priming button or switch 140 is typically moved (depressed) from the first to the second position by an operator (not shown). As can be seen, an electrical conduit 143 electrically couples the priming button 140, when it is located in the second position 142, to the first and second electrical conduits 131 and 132, respectively. Referring still to this same view, that is, FIG. 6, it will be understood that the first temperature control relay 111 receives electrical power from the first and second electrical supply conduits 131 and 132 and is operable to move under given operational conditions between a first electrically closed position, as indicated by the numeral 151, to a second, open, electrical position 152. As should be understood from FIG. 6, the first temperature controlled relay 111 is electrically coupled to the first temperature sensor 71, and with the heater 50 by way of the electrical contactors 90. The first temperature controlled relay 111 is configured to periodically electrically open and close, as illustrated, between the first and second positions 151 and 152, respectively so as to de-energize and energize the heater 50. This periodic energizing and de-energizing of the heater 50 maintains the source of the heated fluid 20A or 20B which is utilized by the object of interest, here illustrated as an internal combustion motor 11, in a predetermined operational temperature range while the pump 40 remains operational. The pump is electrically coupled to the contactors 91. The predetermined operational temperature range for the internal combustion engine or motor 11 is typically about 180° to about 190 degrees F. As earlier discussed, the first temperature sensor 71 is operable for detecting the temperature of the source of fluid 20A or 20B which is received from the object of interest 11 and providing that temperature information to the first temperature controlled relay 111. Further, the second temperature sensor 72 is provided for detecting the temperature of the source of fluid 20A or 20B which is leaving or exiting the heater 50. The temperature information of the second temperature sensor is provided to the second temperature controlled relay 112.

As further understood by a study of FIG. 6, the control circuitry 120 has a second temperature controlled relay which is generally indicated by the numeral 112, and which, as noted above, is electrically coupled to the outside source of electrical power 123 which is provided by the electrical conduits 131 and 132, respectively. The second temperature controlled relay 112 is also electrically controllably coupled with the second temperature sensor 72, the heater 50, and the pump 40. The second temperature controlled relay 112 assumes, during routine operation, a first electrically open position 161, when the temperature of the source of fluid 20A or 20B, as sensed by the second temperature sensor 72 is within the predetermined operational temperature range of the object of interest 11, here depicted as an internal combustion motor 11. Further, the second temperature controlled relay assumes a second, electrically closed position 162 which de-energizes both the heater 50, and the electric pump 40 when the second temperature sensor 72 detects a temperature of fluid 20A or 20B which is greater than the predetermined operational temperature range of the object of interest 11, but less than the maximum operational temperature thereof. For an internal combustion engine or motor 11, this maximum operational temperature is greater than about 200 degrees F. The second temperature controlled relay 112 in this disclosed arrangement does not close if the heating element 50 is not in operation.

The control circuit 120 further has a control switch which is generally indicated by the numeral 170, and which is mounted on the cover 83. As seen in FIG. 6, the control switch 170 has a first or local position 171 which allows for local operation of the fluid heater 10. As seen in FIG. 6, when the control switch 170 is in the local position 171, the local indicator light 85A which is yellow in color, is illuminated on the cover 83 of the electrical control housing 80. Further, when the control switch 170 is placed by an operator in the second or remote position, as indicated by the numeral 172, the remote indicator light 85B is illuminated green, and will be seen on the cover 83, of the electrical control housing 80. Moreover, when the control switch 170 is positioned in the off position 173, no indicator light at all is illuminated on the electrical control housing. As seen in the drawings, when the control circuit 120 detects a malfunction or fault condition, or when the second temperature control relay 112 electrically closes 162, a fault light 85C is illuminated to tell an operator that the fluid heater 10 has been rendered inoperable. Once a fault condition is signaled 85C, an operator must manually reset the system so as to place it back into an operational condition. As seen in FIG. 6, a time delay relay 163 is electrically coupled with the second temperature controlled relay 112. The time delay relay has two switches 164 and 165 which individually move together at the same time to given positions when the second temperature controlled relay 112 moves to a second closed position 162. Under these circumstances, a fault indicator light 85C appears illuminated on the cover 83 of the electrical control box 80 to indicate that that the fluid heater 10 has been rendered inoperable because of conditions that have taken place either within the fluid heater 50 itself, or in the internal combustion motor 11 which might cause damage to both the internal combustion motor 11 and the heater assembly.

Referring still to FIG. 6, it will be seen that the control switch 170, when moved by an operator, not shown, between the local 171, remote 172, and off positions causes electric power 123 to be selectively delivered to the electrical components enclosed in the control box 80. When placed in the remote position, electrical power is provided to the remote on/off relay 104, which is in a normally closed electrical position. Electrical power then travels through the switch 165 and causes the energizing of the motor 41 and heater 50. Typically, the temperature controlled relay 111 would then periodically open and close, so as to cause the heating of the source of fluid 20A/B to a temperature suitable for delivery to the object of interest 11. While this occurs, the second temperature controlled relay 112 remains open. Meanwhile, the second temperature sensor 72 would continue to monitor the temperature of the source of fluid 20A/B leaving the heater. If a malfunction were to occur, such as the first temperature controlled relay 111 stayed continuously closed, or the heater 50 remained energized, the second temperature controlled relay 112, by means of the second temperature sensor 72 would electrically close when the temperature reached a temperature above the predetermined operational temperature range of the overall heating system, but less than the maximum operational temperature of the engine 11 thereof. When the second temperature controlled relay 112 closes, electrical power 123 would be supplied to auxiliary contactor 106A. When this occurs, the contactors 90 and 91 would open, thus effectively electrically decoupling the pump motor 41 and heater 50 from the source of electricity 123. Simultaneously, the switch 164 would close and the normally closed contactor 101 would permit the fault indication light 85C to be energized. By this means, the fluid heater 10 and internal combustion motor are both protected from any damage which might be occasioned by the overheating of the source of fluid 20A and 20B.

OPERATION

The operation of the described embodiment of the present invention 10 is believed to be readily apparent and is briefly summarized at this point.

A first aspect of the present invention relates to a fluid heater 10 which includes an object of interest 11 herein illustrated as an internal combustion motor and which has a predetermined operational temperature range and a maximum operational temperature both of which were earlier disclosed. The invention 10 further includes a source of fluid 20A or 20B, and which is utilized by the object of interest 11. The invention 10 also includes a pump 40 having an electric motor 41, and which, when energized, removes, and returns the source of fluid 20A or 20B from the object of interest 11. A heater 50 is operably coupled to the pump 40, and which, when energized, heats the source of fluid 20A or B which is delivered to the heater by the pump 40. The invention 10 also includes a first temperature sensor 71 for detecting the temperature of the source of fluid 20A or 20B which is received from the object of interest 11. A second temperature sensor 72 is provided for detecting the temperature of the source of fluid 20A or 20B which is leaving the heater 50 after it has been acted upon by the heater elements 55. A first temperature controlled relay 111 is electrically coupled with the first temperature sensor 71, and with the heater 50. The first temperature controlled relay 111 is configured to periodically electrically open 152, and close 151, so as to de-energize and then energize the heater 50 so as to maintain the source of the fluid 20A and 20B utilized by the object of interest 11 in the predetermined operational temperature range, which was earlier disclosed, while the pump 40 remains operational. Further, a second temperature controlled relay 112 is electrically coupled with the second temperature sensor 72; the heater 50; and the pump 40. The second temperature controlled relay 112 assumes an electrically opened position 161 when the temperature of the source fluid 20A or 20B, as sensed by the second temperature sensor 72, is within the predetermined operational temperature range of the object of interest 11. Further, the second temperature controlled relay 112 assumes an electrically closed position 162, which is effective in both de-energizing the heater 50, and the electric pump motor 41, when the second temperature sensor detects a fluid temperature which is greater than the predetermined operational temperature range of the object of interest 11, but less than the maximum operational temperature thereof. This aspect of the invention substantially prevents damage to the invention 10, or object of interest 11 which might be occasioned by needlessly overheating the source of fluid 20A and 20B.

Another aspect of the present invention relates to an object of interest 11 which, in operation, has a predetermined operational temperature range, and a maximum operational temperature. In the depiction as shown in the drawings, the object of interest is an internal combustion motor 11. A source of fluid 20A or 20B is provided, and which is utilized within the object of interest 11, and which facilitates, at least in part, the maintenance of the operational temperature of the object of interest 11. This source of fluid could be a lubricant 20A, or a coolant 20B. A pump 40 is provided and which has an electric pump motor 41, and which is further coupled in fluid flowing relation relative to the object of interest 11, and which, when energized, removes and then returns the source of fluid 20A/B to the object of interest 11. A heater 50 is provided, and which is positioned in downstream fluid receiving relative to the pump 40, and pump motor 41, and which is further located in upstream fluid delivering relation relative to the object of interest 11. The heater 50, when energized, is operable to impart heat energy to the fluid 20A/B which is supplied to the heater 50 by the pump 40. A first temperature sensor 71 is positioned in upstream, fluid flowing relation relative to the heater 50. The first temperature sensor 71 detects the temperature of the fluid 20A/B which is received from the object of interest 11. Further, a second temperature sensor 72 is positioned in downstream, fluid flowing relation relative to the heater 50, and which is also positioned in a location which is upstream relative to the object of interest 11. The second temperature sensor 72 detects the temperature of the fluid 20A/B as the source of fluid leaves the heater 50, and travels or is otherwise directed back to the object of interest 11. A first temperature controlled relay 111, is provided, and which is electrically and controllably coupled to the first temperature sensor 71, and which, when responsive to the temperature signal provided by the temperature sensor 71, and when it electrically closes, 151, is effective in energizing the heater 50. Further, when it assumes an electrically opened position 152, it is effective in de-energizing the heater 50. Further, a second temperature controlled relay 112 is electrically and controllably coupled with the second temperature sensor 72, and further assumes an electrically opened position 161 in response to a second temperature sensor 72 when the temperature of the fluid 20A/B, as sensed by the second temperature sensor 72, is below or within the predetermined operational range of the object of interest 11. The first temperature controlled relay 111 further periodically assumes electrically open, and closed positions, so as to facilitate the heating and maintenance of the fluid 20A/B at a temperature which is within the predetermined operational temperature range of the object of interest 11. Further, the first temperature controlled relay 111 additionally assumes an open electrical position 162 when the temperature of the fluid 20A/B, as sensed by the first temperature sensor 71, exceeds the predetermined operational temperature range, but is below the maximum operational temperature of the object of interest 11 as earlier described. The pump 42, and pump motor 41 continue to operate so as to remove, and then return fluid 20A/B to the object of interest 11, while the heater 50 is periodically energized, and de-energized. Still further, the second temperature sensor 72 when it detects a given fluid temperature which is greater than the predetermined operational temperature range of the object of interest 11, and less than the maximum operational temperature thereof, electrically closes 162, and is effective in de-energizing both the heater 50 and the pump motor 41, of the pump 42 by means of the temperature controlled relay 112, so as to substantially prohibit damage to the fluid heater 50, and the object of interest 11. As earlier noted, once a fault condition is triggered by the second temperature controlled relay 112, the fluid heater 10 may be only manually reset by an operator (not shown) by applying power to the relay 104.

More specifically, the present invention relates to a fluid heater 10 which includes an object of interest 11, which has a predetermined operational temperature range, and a maximum operational temperature. The object of interest here depicted as an internal combustion motor 11, produces a signal for activating and deactivating the fluid heater 10, and further supplies a source of electricity 123 to energize the fluid heater 10. This signal is typically a 24 v DC signal derived from the fuel pump (not shown) of the internal combustion motor 11, although it may be a remote signal sent by the operator from other location. As earlier discussed, a source of fluid 20A/B is utilized by the object of interest 11. A transformer 93 is electrically coupled with the source of electricity 123, and which produces a given voltage output 130 which energizes the fluid heater 10. A motor protective switch 92 is provided, and which is electrically coupled with the source of electricity 123 which is supplied by the object of interest 11. An electric motor 41 is made integral with a fluid pump 40, and which is electrically coupled with the motor protective switch 92. The pump 40 is coupled in fluid withdrawing relation relative to the object of interest 11. The electric motor 41, when energized by the source of electricity 123, causes the pump 40 to withdraw the source of fluid 20A/B from the object of interest 11. A first plurality of electrical contactors 91, is coupled to the source of electricity 123, and positioned therebetween the motor protective switch 92, and the source of electricity 123, and which, when placed in an electrically closed position, electrically couples the electric motor 41 to the source of electricity 123, and when placed in an electrically opened position, decouples the electric motor 41 from the source of electricity 123. A heater 50 is electrically coupled to the source of electricity 123 which is supplied by either an outside source or by the object of interest 11. The heater 50 is further coupled in fluid receiving relation relative to the pump 42, and is also disposed in fluid delivering relation relative to the object of interest 11. The heater 50 is effective, when energized, to heat the source of fluid 20A/B, which is then returned to the object of interest 11. A second plurality of electrical contactors 90 are electrically coupled to the source of electricity 123, and are further positioned therebetween the heater 50, and the source of electricity 123, and which, when energized and disposed in an electrically closed position, electrically couples the heater 50 to the source of electricity 123, and when placed in an electrically open position, electrically decouples the heater 50 from the source of electricity 123. An operator actuated or controlled switch 170 is operably coupled to the fluid heater 50, and the transformer 93, and further disposed in signal receiving relation relative to the object of interest 11, or some other operator selected location, and which activates and deactivates the fluid heater 50. A first temperature sensor 71 is positioned in upstream, fluid flowing relation relative to, and operably coupled with, the heater 50. The first temperature sensor 71 detects the temperature of the source of fluid 20A/B which is received from the object of interest 11. A second temperature sensor 72 is positioned in downstream, fluid flowing relation relative to the heater 50, and which is further positioned upstream relative to the object of interest 11. The second temperature sensor 72 detects the temperature of the fluid 20A/B as the fluid leaves the heater 50, and is further supplied back to the object of interest 11. The invention 10 also provides a first temperature controlled relay 111 which is electrically coupled to the first temperature sensor 71, heater 50, and the second plurality of electrical contacts 90, and which, when electrically closed 151, is effective in energizing the heater 50, and when electrically opened 152, is effective in de-energizing the heater 50. The first temperature controlled relay 111 is configured to periodically electrically open and close so as to de-energize and energize the heater 50 so as to maintain the source of the fluid 20A/B which is utilized by the object of interest 11 in the predetermined operational temperature range while the pump 50 remains operational to first withdraw the source of fluid 20A/B from the object of interest 11, and then subsequently deliver the source of fluid to the heater 50, and then return the source of fluid to the object of interest 11.

A second temperature controlled relay 112 is electrically coupled with the second temperature sensor 72; the heater 50; the pump 40; and the first and second plurality of electrical contactors. The second temperature controlled relay 112 assumes an electrically opened position 161 when the temperature of the source fluid 20A/B, as sensed by the second temperature sensor 72, is within the predetermined operational temperature range of the object of interest 11, and further assumes an electrically closed position 162, which is effective in causing the first and second plurality of contactors 90 and 91 to assume an open electrical position which de-energizes the heater 50, and electric motor 41 which energizes the pump 40, when the second temperature sensor 72 detects a fluid temperature which is greater than the predetermined operational temperature range of the object of interest 11, as earlier disclosed, but less than the maximum operational temperature thereof. As earlier noted, this is caused by the action of closing the temperature controlled relay 112.

Therefore, it will be seen that the present invention provides a convenient means by which a heater assembly can be installed on an object of interest such as an internal combustion motor and which may maintain the internal combustion motor at a temperature which allows the object of interest to operate effectively when needed notwithstanding the ambient temperature or conditions of the environment surrounding the internal combustion motor.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A circuit for detecting a fault response for a heater, the circuit comprising:

a temperature sensor measuring a fluid temperature at an exit of the heater;

a first temperature control relay energizing or de-energizing an element of the heater; and a second temperature control relay electrically coupled to an auxiliary contactor, the second temperature control relay triggering a fault responsive to the temperature sensor measuring the fluid temperature over a predetermined temperature and to the first temperature control relay energizing the element of the heater, and responsive to triggering the fault, the second temperature control relay energizes the auxiliary contactor to decouple the heater from a source of electricity to prevent the first temperature control relay from energizing the element of the heater, and the second temperature control relay not triggering the fault responsive to the temperature sensor measuring the fluid temperature over the predetermined temperature and to the first temperature control relay de-energizing the element of the heater.

2. The circuit of claim 1, further comprising an internal combustion engine, and wherein the predetermined temperature is within or below a predetermined operational temperature range for the internal combustion engine.

3. The circuit of claim 1, wherein the predetermined temperature is about 180 degrees F.

4. The circuit of claim 1, further comprising a pump motor, wherein the energized auxiliary contactor further decouples the pump motor from the energy source to render a pump inoperable.

5. The circuit of claim 1, further comprising a fault indication light, wherein the energized auxiliary contactor further energizes a fault indication light.

6. A system comprising:

a heater for heating a fluid including a fluid intake and a fluid exhaust; and a control circuit for detecting a fault response for the heater, the control circuit including:

a first temperature sensor measuring a temperature of the fluid at the intake of the heater and electrically coupled to a first temperature control relay, the first temperature control relay to energize or de-energize the heater; and a second temperature sensor measuring a temperature of the fluid at the exhaust of the heater and electrically coupled to a second temperature control relay electrically coupled to an auxiliary contactor, the second temperature control relay to electrically decouple the heater from a source of electricity;

wherein the control circuit detects the fault response when the second temperature sensor measuring the temperature of the fluid at the exhaust of the heater is over a predetermined temperature and the first temperature control relay is energizing the heater, and responsive to detecting the fault, the second temperature control relay energizes the auxiliary contactor to decouple the heater from the source of electricity to prevent the first temperature control relay from energizing the heater; and wherein the control circuit does not detect the fault response when the second temperature sensor measuring the temperature of the fluid at the exhaust of the heater is over the predetermined temperature and the first temperature control relay is de-energizing the heater.

7. The system of claim 6, wherein the heater is coupled in fluid flowing relation relative to an internal combustion engine, and wherein the predetermined temperature is within or below a predetermined operational temperature range for the internal combustion engine.

8. The system of claim 6, wherein the predetermined temperature is about 180 degrees F.

9. The system of claim 6, further comprising a pump having a motor, and wherein the second temperature control relay further electrically decouples the motor of the pump from the source of electricity to render a pump inoperable.

10. The system of claim 6, further comprising a fault indication light, and wherein the energized auxiliary contactor further energizes a fault indication light.

* * * * *